US008544194B2

(12) United States Patent
Lin

(10) Patent No.: US 8,544,194 B2
(45) Date of Patent: Oct. 1, 2013

(54) LENGTH-ADJUSTABLE SNOWSHOE

(76) Inventor: Chao-Ming Lin, Gangshan Township, Koahsiung County (TW)

( * ) Notice: Subject to any disclaimer, the term of this patent is extended or adjusted under 35 U.S.C. 154(b) by 445 days.

(21) Appl. No.: 12/971,059

(22) Filed: Dec. 17, 2010

(65) Prior Publication Data

US 2012/0151802 A1 Jun. 21, 2012

(51) Int. Cl.
*A43B 5/04* (2006.01)

(52) U.S. Cl.
USPC ..... 36/122; 36/123; 36/125; 36/97

(58) Field of Classification Search
USPC ..... 36/122, 123, 124, 125, 97
See application file for complete search history.

(56) References Cited

U.S. PATENT DOCUMENTS

| | | | | |
|---|---|---|---|---|
| 5,493,794 | A * | 2/1996 | McKenzie et al. | 36/122 |
| 6,163,984 | A * | 12/2000 | Faber et al. | 36/125 |
| 6,195,919 | B1 * | 3/2001 | Forrest et al. | 36/122 |
| 7,493,709 | B2 * | 2/2009 | Trask et al. | 36/122 |
| 7,793,439 | B2 * | 9/2010 | Chartrand et al. | 36/124 |
| 2003/0101623 | A1 * | 6/2003 | Settelmayer | 36/124 |
| 2007/0079529 | A1 * | 4/2007 | Ekberg | 36/122 |
| 2007/0163151 | A1 * | 7/2007 | Monsees et al. | 36/122 |
| 2007/0251127 | A1 * | 11/2007 | Gallay | 36/122 |
| 2008/0172908 | A1 * | 7/2008 | Tatsuno | 36/124 |
| 2008/0178494 | A1 * | 7/2008 | Gallay et al. | 36/124 |
| 2009/0172974 | A1 * | 7/2009 | Faber et al. | 36/124 |

* cited by examiner

*Primary Examiner* — Shelley Self
*Assistant Examiner* — Cameron Carter
(74) *Attorney, Agent, or Firm* — Alan Kamrath; Kamrath IP Law Firm, P.A.

(57) ABSTRACT

A length-adjustable snowshoe includes a frame and a carrier fixed to the frame. A connecting member mounted to the frame includes two receiving holes. A pivotal portion is formed on a top side of the connecting member. A compartment extends from the pivotal portion through one of the receiving holes. An extension member includes legs slideably received in the receiving holes and is slideable between first and second positions. A sliding member is mounted on the extension member to move therewith. A positioning member is received in the compartment and pivotable between a stop position and a releasing position. The positioning member in the stop position retains the extension member in any location including and intermediate the first and second positions. The extension member can slide between the first and second positions when the positioning member is in the releasing position.

3 Claims, 6 Drawing Sheets

LENGTH-ADJUSTABLE SNOWSHOE

BACKGROUND OF THE INVENTION

The present invention relates to a snowshoe and, more particularly, to a length-adjustable snowshoe in which a contact area between the snowshoe and the snow can be adjusted to allow easy walking on the snow and preventing the foot of the wearer wearing the snowshoe from sinking into the snow.

Snowshoes can increase the contact area with the ground covered with snow, preventing the feet of the wearer from sinking into the snow and helping the wearer to walk on the snow. Conventional snowshoes generally include a bottom board, a step board mounted on the bottom board, a plurality of fastening straps mounted on the step board, and at least one toothed portion located below the step board. The bottom board is a steel tube bent into an elliptic shape and covered by a plastic plate. The bottom board has an area much larger than that of a shoe worn by the wearer of the snowshoe to increase the contact area with the snow, distributing the pressure on the snow and preventing the foot of the wearer from sinking into the snow. The wearer can wear an ordinary shoe and step on the step board. The shoe is fixed on the snowshoe by the fastening straps, securely engaging the snowshoe with the foot of the wear. The toothed portion on the step board can pierce into the snow covered ground to increase the ground catching capability of the snowshoe. Thus, the wearer can walk easily on the snow.

However, walking on the snow will become difficult if the bottom board has an excessive contact area with the snow. Thus, manufacturers produce snowshoes of differing sizes for users of differing foot sizes and differing weights. Furthermore, a user walking on soft snow will have to wear a snowshoe of a size larger than that for walking on hard snow. Conventional snowshoes are not adjustable and, thus, not convenient to the users.

Thus, a need exists for an adjustable snowshoe that can be adjusted according to differing situations and to differing users having differing foot sizes while reducing the manufacturing costs.

BRIEF SUMMARY OF THE INVENTION

To fulfill the above objective, the present invention provides a length-adjustable snowshoe including a frame having first and second engagement sections spaced along a first axis. A carrier is fixed to the frame. A shoe-fixing device is adapted to be mounted to the carrier. A connecting member is mounted to the first and second engagement sections of the frame. The connecting member includes top and bottom sides spaced along the second axis. The connecting member further includes first and second sides extending between the top and bottom sides. The first and second sides of the connecting member are spaced along a third axis perpendicular to the first and second axes. A pivotal portion is formed on the top side of the connecting member. The connecting portion further includes two receiving holes extending from the first side through the second side along the first axis. A compartment extends from the pivotal portion through one of the receiving holes. An extension member includes first and second legs slideably received in the receiving holes of the connecting member. The extension member is slideable along the third axis between first and second positions. A sliding member is mounted on the extension member to move therewith. A positioning member is pivotably received in the compartment of the connecting member. The positioning member includes a lobe. The lobe has a protruded positioning portion and a recessed releasing portion.

The positioning member is pivotable in the compartment between a stop position and a releasing position. The positioning portion presses against the first leg of the extension member to retain the extension member in the first position, the second position, or any location between the first and second positions when the positioning member is in the stop position. When the positioning member is in the releasing position, the releasing portion is aligned with and does not press against the first leg, and the positioning portion is disengaged from and does not press against the first leg, allowing the extension member to slide between the first and second positions. A distal end of the first leg of the extension member has a first spacing to the first side of the connecting member along the third axis when the extension member is in the first position. The distal end of the extension member has a second spacing to the first side of the connecting member along the third axis. The first spacing is larger than the second spacing.

In a preferred embodiment, each of the first and second engagement sections has an engaging end. The connecting member includes first and second engaging holes extending from the first side towards but spaced from the second side of the connecting member along the third axis. The first and second engaging holes are spaced along the first axis. The receiving holes are located intermediate the first and second engaging holes. The engaging end of each of the first and second engagement sections is received in one of the first and second engaging holes. The carrier includes a tail located below and fixed to the bottom side of the connecting member. The sliding member includes two through-holes through which the first and second legs extend. The sliding member further includes two lateral sides each having a lug. Each lug has an engaging member aligned with one of the through-holes. The sliding member further includes a protrusion on a top face thereof. The connecting member further includes a recess extending from the second side towards but spaced from the first side of the connecting member. Each of the first and second legs of the extension member extends through one of the through-holes and is engaged with one of the engaging members. When the extension member is in the first position, the protrusion is received in the recess of the connecting member, preventing the extension member from moving towards the carrier along the third axis. When the extension member is in the second position, the protrusion is disengaged from the recess of the connecting member, and the lugs of the sliding member abut against the first side of the connecting member, preventing the extension member from moving away from the carrier along the third axis.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

Figure 1:
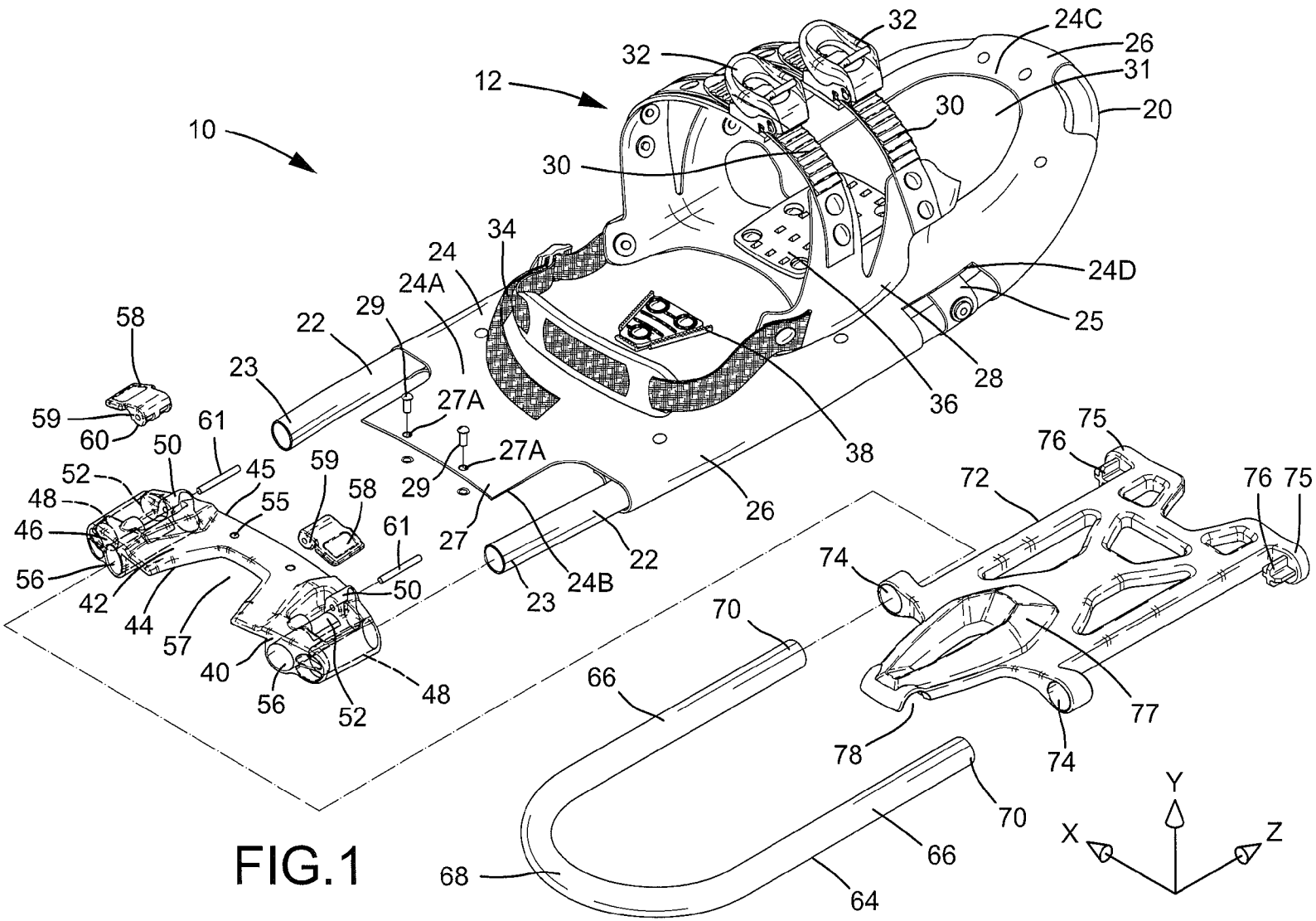
FIG. 1 shows an exploded, perspective view of a length-adjustable snowshoe according to the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "lower", "upper", "top", "bottom", "front", "rear", "inner", "outer", "side", "end", "portion", "section", "lateral", "spacing", "length", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A snowshoe according to the preferred teachings of the present invention is shown in the drawings and generally designated 10. According to the preferred form shown, snowshoe 10 includes a frame 20 in the form of a U-shaped tube. Frame 20 includes two rectilinear engagement sections 22 spaced along a first axis X and an intermediate section between engagement sections 22. Each engagement section 22 has an engaging end 23. Snowshoe 10 further includes a carrier 24 mounted on frame 20 and made of high-strength plastic material. Carrier 24 includes upper and lower faces 24A and 24B spaced along a second axis Y perpendicular to first axis X. Carrier 24 further includes front and rear ends 24C and 27 spaced along a third axis Z perpendicular to first and second axes X and Y. Carrier 24 further includes two lateral sides 24D spaced along first axis X. A plurality of wings 26 extends from front end 24C and lateral sides 24D. A through-hole 31 extends from upper face 24A through lower face 24B along second axis Y. Through-hole 31 is located adjacent front end 24C. Rear end 27 includes a tail having two holes 27A extending from upper face 24A through lower face 24B along second axis Y. Carrier 24 is mounted on frame 20 with lateral sides 24D parallel to engagement sections 22 and with rear end 27 of carrier 24 located adjacent engaging ends 23 of frame 20. Wings 26 of carrier 24 wrap around engagement sections 22 and the intermediate section of frame 20. Rivets are extended through wings 26 of carrier 24 to fix carrier 24 to frame 20.

According to the preferred form shown, snowshoe 10 further includes a flexible fixing member 25 extending along first axis X and having two ends wrapping around frame 20 and fixed by rivets. Fixing member 25 extends across through-hole 31 and has a portion exposed outside of through-hole 31. A shoe fixing device 12 is mounted on carrier 24 and includes an enclosure member 28 and a front stop 36 mounted on enclosure member 28. Rivets are extended through front stop 36, enclosure member 28 and the portion of fixing member 25 exposed outside of through-hole 31 of carrier 24. Thus, enclosure member 28 is reliably fixed to fixing member 25. A toothed member 33 is fixed to a front end of enclosure member 28.

According to the preferred form shown, shoe fixing device 12 further includes two toothed straps 30 each having an end fixed to enclosure member 28. Each toothed strap 30 has a plurality of ratchet teeth on an upper side thereof. Shoe fixing device 12 further includes two adjusting buckles 32 each having a catch. Each adjusting buckle 32 has a space through which one of toothed straps 30 extends. The catch of each adjusting buckles 32 is releasably engaged with one of the ratchet teeth on one of toothed straps 30, allowing adjustment of the shoe fixing device 12 according to a shoe worn by a wearer of snowshoe 10. Shoe fixing device 12 further includes an adjustable heel strap 34 fixed to a rear side of enclosure member 28. Shoe fixing device 12 further includes a rear stop 38 riveted to carrier 24 and spaced from front stop 36 along third axis Z, providing resistance to a sole of the shoe worn by the wearer to assist in walking.

According to the preferred form shown, snowshoe 10 further includes a connecting member 40 having top and bottom sides 42 and 44 spaced along second axis Y. Connecting member 40 further includes first and second sides 45 and 46 spaced along third axis Z and extending between top and bottom sides 42 and 44. Two engaging holes 48 extend from first side 45 towards but spaced from second side 46 along third axis Z. Two receiving holes 56 extend from first side 45 through second side 46 along third axis Z. Receiving holes 56 are spaced from engaging holes 48 along first axis X and intermediate engaging holes 48 along first axis X. Two pivotal portions 50 are formed on top side 42 of connecting member 40. A compartment 52 extends from each pivotal portion 50 through one of receiving holes 56. A recess 57 extends from second side 46 towards but spaced from first side 45 along third axis Z. Two fixing holes 55 extend from top side 42 through bottom side 44. It can be appreciated that pivotal portions 50 are not limited to be formed on top side 42. Connecting member 40 is fixed to frame 20 with each engaging end 23 of frame 20 received in one of engaging holes 48. The tail of rear end 27 of carrier 24 is located below bottom side 44 of carrier 24 with holes 27A aligned with fixing holes 55. Two rivets 29 are extended through holes 27A and fixing holes 55, fixing connecting member 40 to frame 20 and carrier 24.

Figure 4:
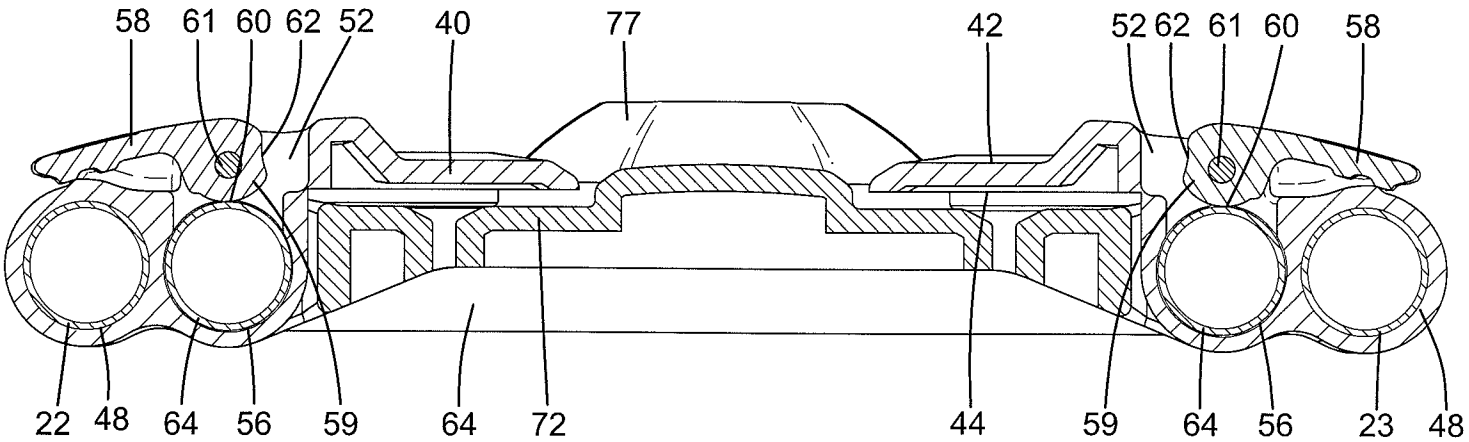
FIG. 4 shows a cross sectional view of the snowshoe of FIG. 1 according to section line 4-4 of FIG. 2.
Figure 5:
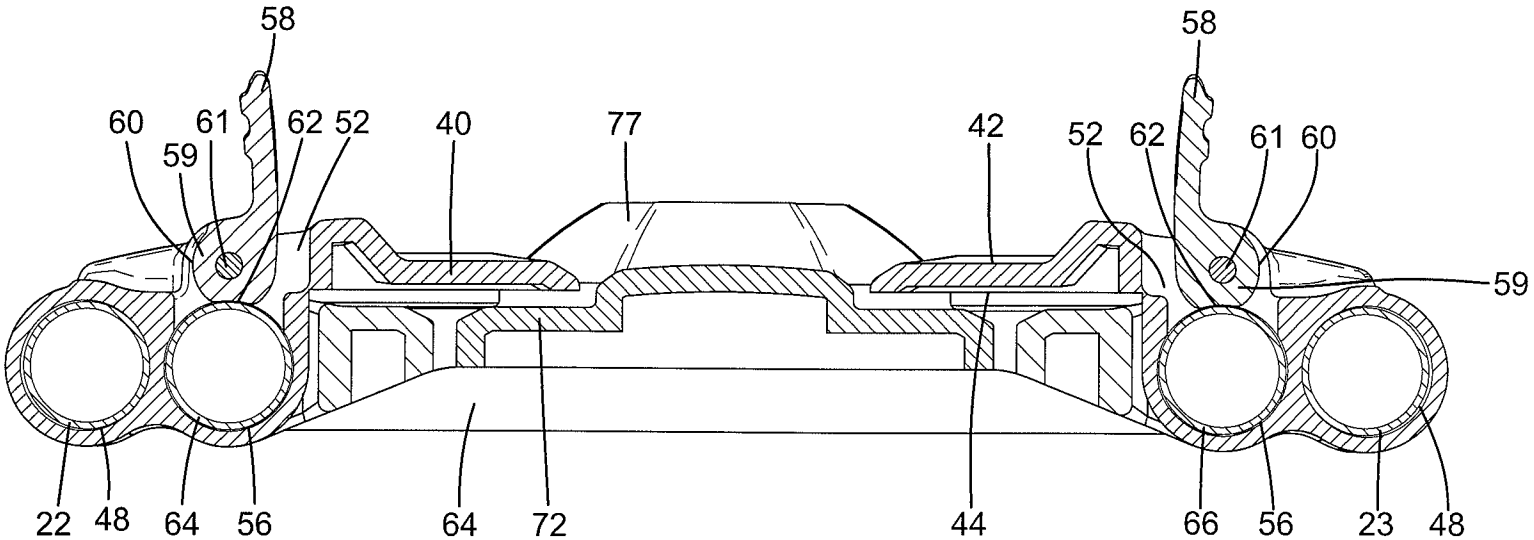
FIG. 5 shows a cross sectional view similar to FIG. 3, with each of two positioning members pivoted to a releasing position.

According to the preferred form shown, snowshoe 10 further includes two positioning members 58 each having a lobe 59. Lobe 59 includes a protruded positioning portion 60 and a recessed releasing portion 62 on an outer periphery thereof (FIG. 4). Each positioning member 58 is pivotably mounted to one of pivotal portions 50 by extending a pin 61 through lobe 59 into pivotal portion 50. Lobes 59 are pivotably received in compartments 52. Each positioning member 58 is pivotable about third axis Z between a stop position (FIG. 4) and a releasing position (FIG. 5).

According to the preferred form shown, snowshoe 10 further includes an extension member 64 in the form of a U-shaped tube. Extension member 64 includes two rectilinear legs 66 each having a distal end 70. Extension member 64 further includes an arcuate connecting portion 68 between legs 66. A sliding member 72 is mounted on extension member 64 and includes two through-holes 74 through which legs 66 extend. Two lugs 75 are respectively formed on two lateral sides of sliding member 72 spaced along first axis X. An engaging member 76 is formed on a rear face of each lug 75 and is aligned with one of through-holes 74. Sliding member 72 further includes a recessed portion 78 on a bottom face thereof. A protrusion 77 is formed on a top face of sliding member 72 and located adjacent to recessed portion 78.

Sliding member 72 is located below bottom side 44 of connecting member 40. A spacing between the top face of sliding member 72 and bottom side 44 of connecting member 40 is slightly larger than a thickness of the tail of rear end 27 of carrier 24 along second axis Y. Each through-hole 74 of sliding member 72 is aligned with one of receiving holes 56 of connecting member 40. Each receiving hole 56 is located intermediate one of through-holes 74 and one of engaging members 76 of sliding member 72. Each leg 66 of extension member 64 is slideably extended through one of through-holes 74 and engaged with one of engaging members 76 of sliding member 72. Recessed portion 78 of sliding member 72 engages with connecting portion 68 of extension member 64, preventing extension member 64 from moving away from engaging members 76 and, thus, preventing extension member 64 from disengaging from sliding member 72. Extension member 64 and sliding member 72 can move jointly between first and second positions along third axis Z. When extension member 64 is in the first position, each distal end 70 of extension member 64 has a first spacing to first side 45 of connecting member 40 along third axis Z. When extension member 64 is in the second position, each distal end 70 of extension member 64 has a second spacing to first side 45 of connecting member 40 along third axis Z. The first spacing is larger than the second spacing.

Figure 2:
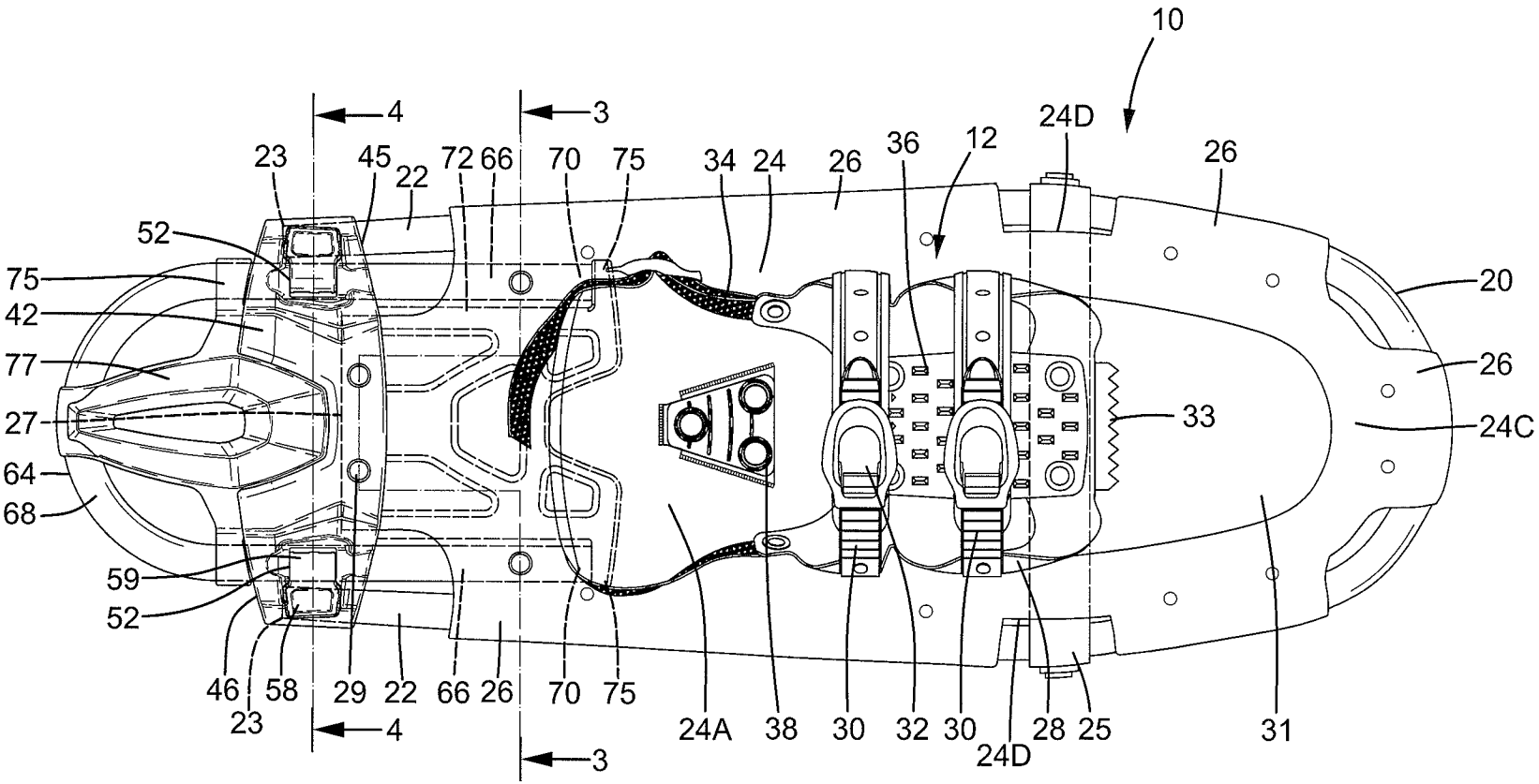
FIG. 2 shows a top view of the snowshoe of FIG. 1 with the snowshoe adjusted to a minimal size.
Figure 3:
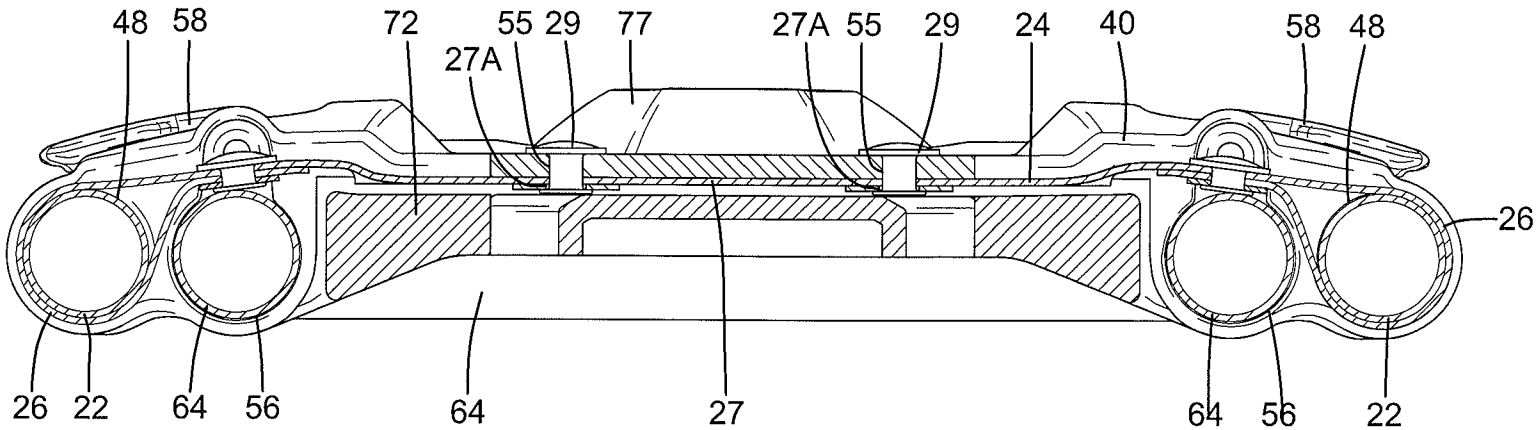
FIG. 3 shows a cross sectional view of the snowshoe of FIG. 1 according to section line 3-3 of FIG. 2.

Now that the basic construction of snowshoe 10 of the preferred teachings of the present invention has been explained, the operation and some of the advantages of snowshoe 10 can be set forth and appreciated. In particular, for the sake of explanation, it will be assumed that extension member 64 is in the first position (FIG. 2) such that snowshoe 10 has a minimal length along third axis Z. In the first position, protrusion 77 of sliding member 72 is received in recess 57 and abuts an edge of recess 57, preventing extension member 64 from moving towards carrier 24 along third axis Z. Each positioning member 58 is in the stop position (FIG. 4) with positioning portion 60 of positioning member 58 pressing against a surface of one of legs 66 of extension member 64, frictionally retaining extension member 64. In this position, snowshoe 10 has a minimal size and, thus, has a minimal contact area with the snow.

In use, a wearer places a shoe worn on his or her foot into enclosure member 28 and adjusts toothed straps 30 by using adjusting buckles 32 to securely clamp toothed straps 30 around the vamp of the shoe. Heel strap 34 is adjusted according to the length of the shoe. A sole of the shoe rests on front and rear stops 36 and 38. When walking on the snow, enclosure member 28 allows shoe fixing device 12 to pivot relative to carrier 24 due to the elasticity of fixing member 25. Toothed member 33 can penetrate into the snow to assist in walking.

Figure 6:
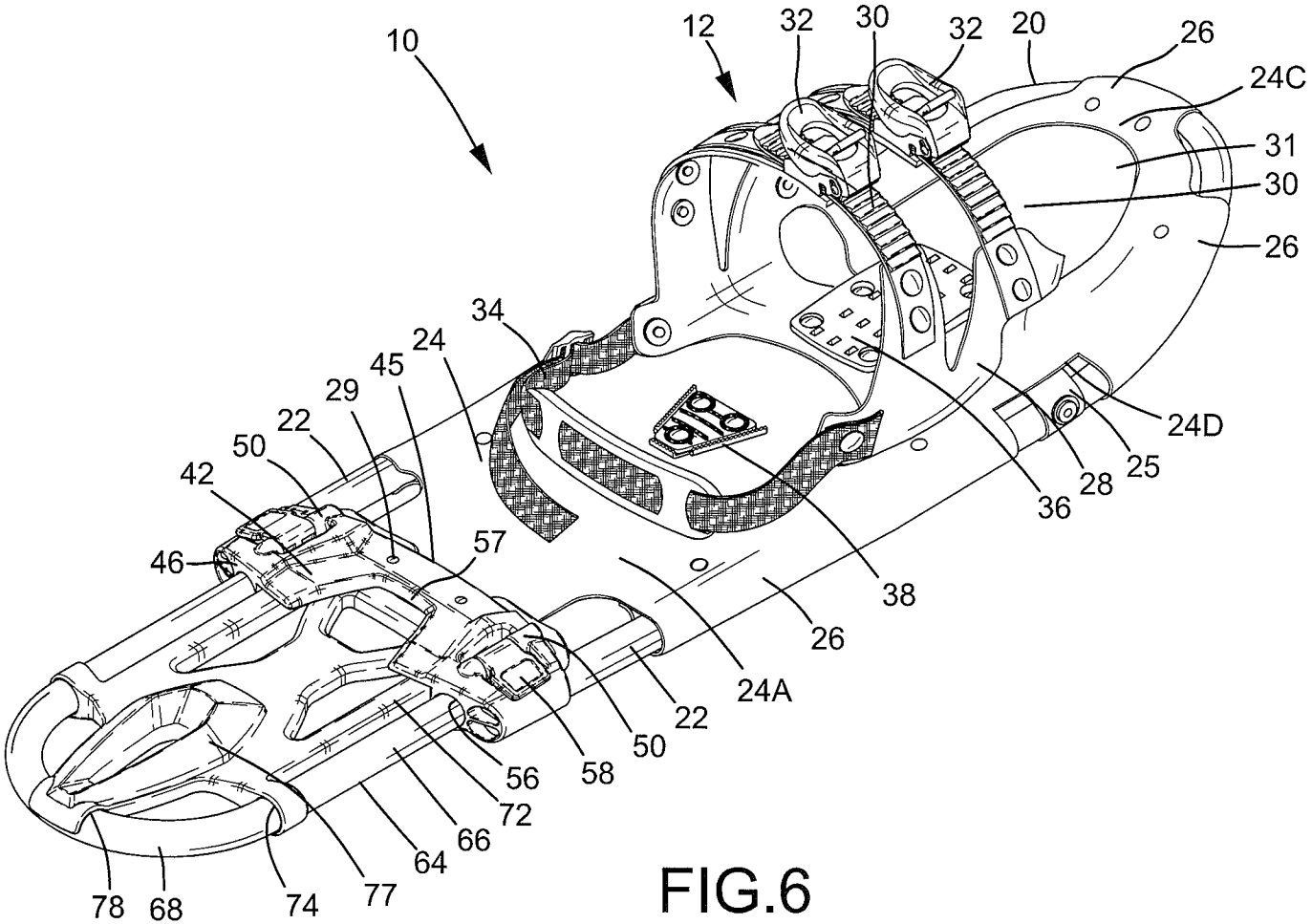
FIG. 6 shows a perspective view of the snowshoe of FIG. 1 with the snowshoe adjusted to a maximal size.

In a case the snow is soft, the contact area between snowshoe 10 and the snow must be increased to prevent snowshoe 10 from sinking into the snow. In this case, positioning members 58 are pivoted to the releasing positions (FIG. 5) such that releasing portions 62 of positioning members 58 are aligned with and do not press against legs 66 of extension member 64. Thus, positioning members 58 disengage from and no longer press against legs 66. Extension member 64 and sliding member 72 can move jointly from the first position (FIG. 2) to the second position (FIG. 6). When extension member 64 is in the second position, lugs 75 of sliding member 72 abut against and are positioned by first side 45 of connecting member 40, preventing extension member 64 from moving away from carrier 24 along third axis Z. Snowshoe 10 has the maximal size when extension member 64 is in the second position, providing the maximal contact area with the snow. Nevertheless, since an excessive size of snowshoe 10 causes adverse affect to walking on the snow, extension member 64 of snowshoe 10 can be retained in any location between the first and second positions. The wearer can simply move extension member 64 to the desired location and then pivot positioning members 58 from the releasing positions (FIG. 5) to the stop positions (FIG. 4).

By providing sliding engagement between connecting member 40 and extension member 64, the wearer can easily and rapidly adjust the size of snowshoe 10 according to the hardness of the snow and to the foot size and the weight of the wearer, providing convenience to the wearer. Furthermore, no rivets are required in the assemblage of extension member 64 and sliding member 72, increasing the assembling speed.

Now that the basic teachings of the present invention have been explained, many extensions and variations will be obvious to one having ordinary skill in the art. For example, rear end 27 of carrier 24 does not have to include the tail. In this case, connecting member 40 can be fixed to engaging ends 23 of frame 20 by rivets or screws after engagement sections 22 of frame 20 are received in engaging holes 48 of connecting member 40. Alternatively, connecting member 40 does not have to include engaging holes 48, and rear end 27 of carrier 24 does not have to include the tail. In this case, connecting member 40 can include two rods extending from first side 45 along third axis Z into holes in engagement sections 22 in frame 20 and then fixed to engaging ends 23 by rivets or screws. It can be appreciated that shoe fixing device 12 of other types and shapes can be used to retain the shoe worn by the wearer of snowshoe 10. Furthermore, snowshoe 10 does not have to include fixing member 25, and shoe fixing device 12 can be riveted to carrier 24 at a location adjacent through-hole 31 such that shoe fixing device 12 can pivot due to the elasticity of carrier 24. Further, connecting member 40 can include only one compartment 52, and snowshoe 10 can include only one positioning member 58.

Furthermore, sliding member 72 can be of other shapes. As an example, sliding member 72 can be made of the high-strength plastic material for making carrier 24 and can include wings wrapping around legs 66 and connecting portion 68 of extension member 64, providing the same function of increasing the contact area between snowshoe 10 and the snow when the size of snowshoe 10 is increased through adjustment.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A length-adjustable snowshoe comprising:

a frame including first and second engagement sections spaced along a first axis;

a carrier fixed to the frame, with a shoe-fixing device adapted to be mounted to the carrier;

a connecting member mounted to the first and second engagement sections of the frame, with the connecting member including top and bottom sides spaced along a second axis perpendicular to the first axis, with the connecting member further including first and second sides extending between the top and bottom sides, with the first and second sides of the connecting member spaced along a third axis perpendicular to the first and second axes, with a pivotal portion formed on the top side of the connecting member, with the connecting member further including two receiving holes extending from the first side through the second side along the first axis, with a compartment extending from the pivotal portion through one of the two receiving holes;

an extension member including first and second legs slideably received in the two receiving holes of the connecting member, with the extension member slideable along the third axis between first and second positions;

a sliding member mounted on the extension member to move therewith; and a positioning member pivotably received in the compartment of the connecting member and pivotable relative to the connecting member about an axis parallel to the third axis, with the positioning member including a lobe, with the lobe including a protruded positioning portion and a recessed releasing portion, with the positioning member pivotable in the compartment between a stop position and a releasing position, with the positioning portion pressing against the first leg of the extension member to retain the extension member in the first position, the second position, and any location between the first and second positions when the positioning member is in the stop position, with the releasing portion aligned with and not pressing against the first leg and with the positioning portion disengaged from and not pressing against the first leg when the positioning member is in the releasing position, allowing the extension member to slide between the first and second positions, with a distal end of the first leg of the extension member having a first spacing to the first side of the connecting member along the third axis when the extension member is in the first position, with the distal end of the extension member having a second spacing to the first side of the connecting member along the third axis, with the first spacing larger than the second spacing.

2. The length-adjustable snowshoe as claimed in claim 1, with each of the first and second engagement sections having an engaging end, with the connecting member including first and second engaging holes extending from the first side towards but spaced from the second side of the connecting member along the third axis, with the first and second engaging holes spaced along the first axis, with the two receiving holes located intermediate the first and second engaging holes, with the engaging end of each of the first and second engagement sections received in one of the first and second engaging holes, with the first and second legs of the extension member located between the engaging ends of the first and second engagement sections of the frame along the first axis, with the carrier including a tail located below and fixed to the bottom side of the connecting member.

3. The length-adjustable snowshoe as claimed in claim 1, with the sliding member including two through-holes through which the first and second legs extend, with the sliding member further including two lateral sides each having a lug, with each lug having an engaging member (76) aligned with one of the two through-holes, with the sliding member further including a protrusion on a top face thereof, with the connecting member further including a recess extending from the second side towards but spaced from the first side of the connecting member, with each of the first and second legs of the extension member extending through one of the two through-holes and engaged with one of the engaging members, wherein when the extension member is in the first position, the protrusion is received in the recess of the connecting member, preventing the extension member from moving towards the carrier along the third axis, wherein when the extension member is in the second position, the protrusion is disengaged from the recess of the connecting member, the lugs of the sliding member abut against the first side of the connecting member, preventing the extension member from moving away from the carrier along the third axis.

* * * * *